US010130166B1

(12) United States Patent
Prokopovich

(10) Patent No.: US 10,130,166 B1
(45) Date of Patent: Nov. 20, 2018

(54) COLLAPSIBLE TABLE ASSEMBLY

(71) Applicant: Diana Prokopovich, Marietta, GA (US)

(72) Inventor: Diana Prokopovich, Marietta, GA (US)

( * ) Notice: Subject to any disclaimer, the term of this patent is extended or adjusted under 35 U.S.C. 154(b) by 0 days.

(21) Appl. No.: 15/704,433

(22) Filed: Sep. 14, 2017

(51) Int. Cl.

| | |
|---|---|
| ***A47B 3/00*** | (2006.01) |
| ***A47B 3/06*** | (2006.01) |
| ***A47B 13/16*** | (2006.01) |
| ***A47G 19/10*** | (2006.01) |
| ***B65D 25/24*** | (2006.01) |
| ***B65D 33/14*** | (2006.01) |

(52) U.S. Cl.
CPC ..... *A47B 3/06* (2013.01); *A47B 13/16* (2013.01); *A47G 19/10* (2013.01); *B65D 25/24* (2013.01); *B65D 33/14* (2013.01)

(58) Field of Classification Search
CPC .. A47B 3/06; A47B 3/10; A47B 13/16; A47B 13/14; A47B 2003/008; A47B 2013/006; A47B 37/00; A47G 19/10; B65D 33/14
See application file for complete search history.

(56) References Cited

U.S. PATENT DOCUMENTS

| | | | | |
|---|---|---|---|---|
| 2,400,320 | A * | 5/1946 | Trefry | A47B 3/10 108/35 |
| 2,850,079 | A * | 9/1958 | Prushnok | A47G 19/10 248/310 |
| 4,122,780 | A * | 10/1978 | Brickman | A47B 3/02 108/25 |
| 4,887,536 | A | 12/1989 | Teichner | |
| 6,032,590 | A * | 3/2000 | Chen | A47B 3/06 108/158.12 |
| 6,705,240 | B2 | 3/2004 | Block et al. | |
| 8,245,650 | B1 | 8/2012 | McKsymick | |
| 9,215,923 | B1 * | 12/2015 | Boone | A47B 13/021 |
| D747,618 | S | 1/2016 | Berkowitz | |
| 9,392,868 | B2 | 7/2016 | Nardi | |
| 9,770,096 | B1 * | 9/2017 | Meyer | A47B 3/10 |
| 2007/0056482 | A1 * | 3/2007 | Robinson | A47B 3/06 108/25 |
| 2008/0072802 | A1 * | 3/2008 | de Oliveira | A47B 3/06 108/12 |
| 2009/0000528 | A1 * | 1/2009 | Leng | A47B 3/06 108/156 |
| 2012/0085271 | A1 * | 4/2012 | Lin | A47B 3/06 108/156 |
| 2012/0103999 | A1 * | 5/2012 | Weidner | A47G 19/10 220/574 |
| 2012/0237142 | A1 * | 9/2012 | Derkoski | A47B 3/06 383/6 |
| 2014/0102337 | A1 | 4/2014 | Ralph et al. | |
| 2016/0015177 | A1 * | 1/2016 | Blake | A47B 87/002 108/64 |
| 2017/0042321 | A1 | 2/2017 | Clause et al. | |

* cited by examiner

*Primary Examiner* — Daniel J Rohrhoff

(57) ABSTRACT

A collapsible table assembly includes a table for supporting objects. A plurality of legs is provided and each of the legs is removably coupled to the table. A plurality of containers is provided and each of the containers is removably coupled to the table thereby inhibiting the containers from falling over. A plurality of mating members is provided and each of the mating members is coupled to the table. A pouch is selectively suspended from the mating members and the pouch stores objects.

3 Claims, 5 Drawing Sheets

COLLAPSIBLE TABLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to table devices and more particularly pertains to a new table device for supporting objects in a remote location.

BRIEF SUMMARY OF THE INVENTION

An embodiment of the disclosure meets the needs presented above by generally comprising a table for supporting objects. A plurality of legs is provided and each of the legs is removably coupled to the table. A plurality of containers is provided and each of the containers is removably coupled to the table thereby inhibiting the containers from falling over. A plurality of mating members is provided and each of the mating members is coupled to the table. A pouch is selectively suspended from the mating members and the pouch stores objects.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
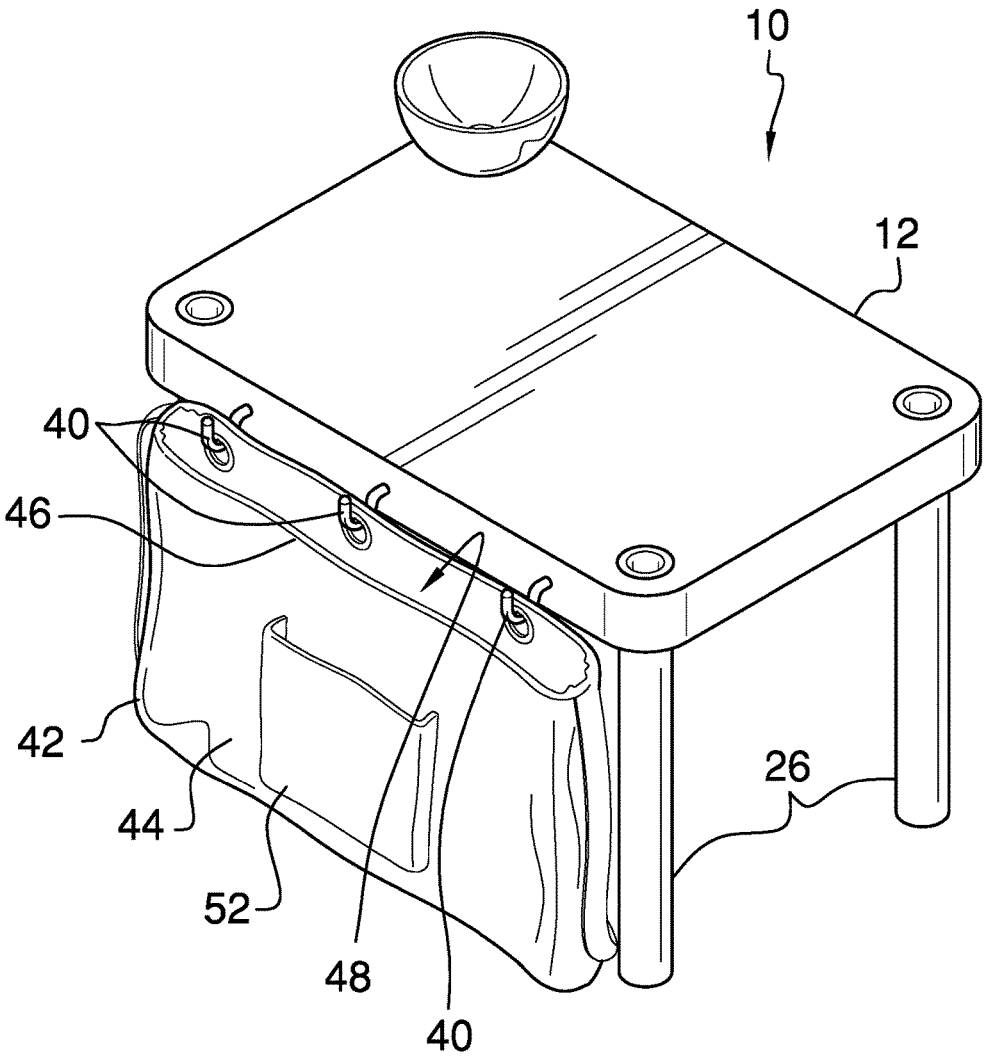
FIG. 1 is a top perspective view of a collapsible table assembly according to an embodiment of the disclosure.
Figure 2:
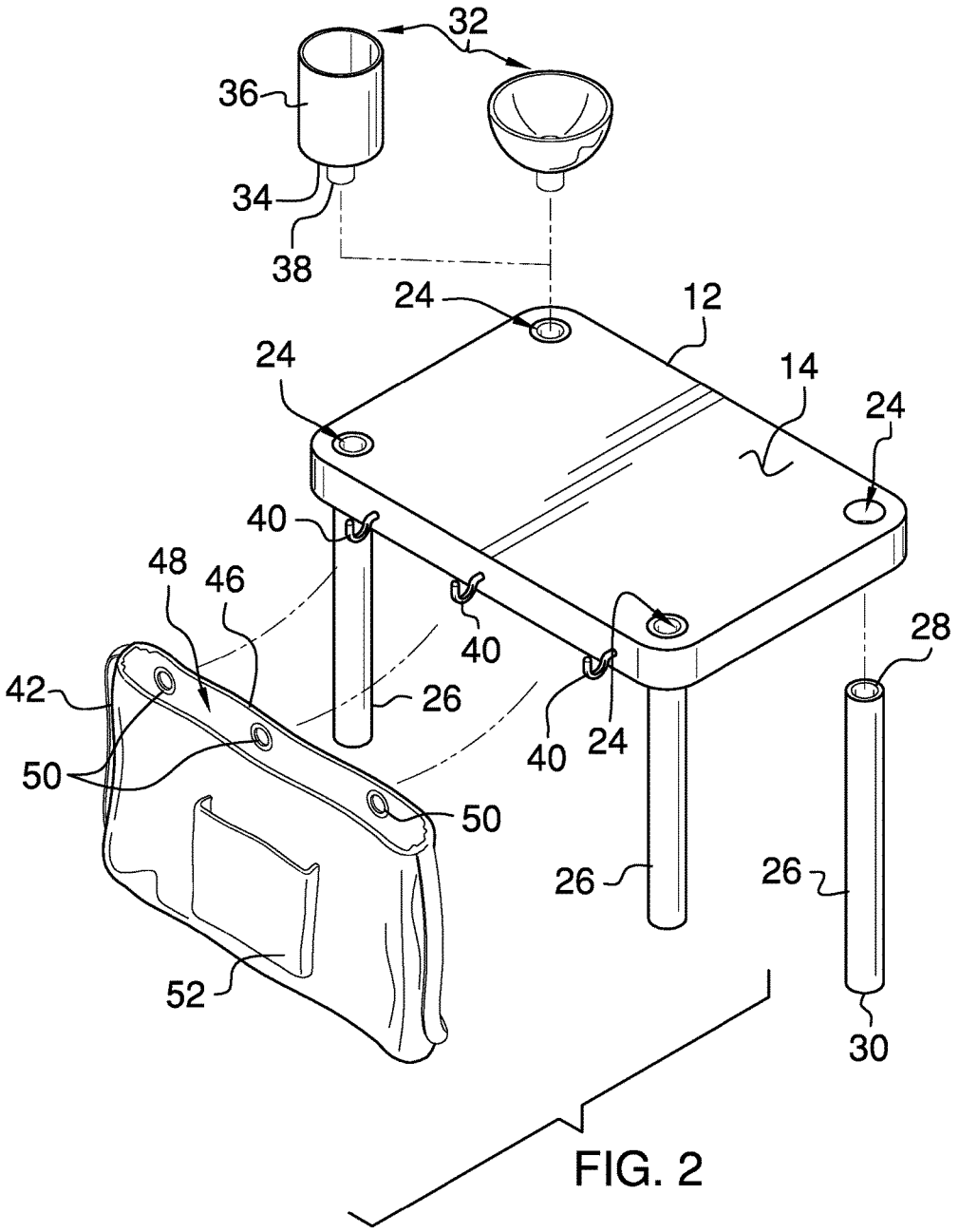
FIG. 2 is an exploded perspective view of an embodiment of the disclosure.
Figure 3:
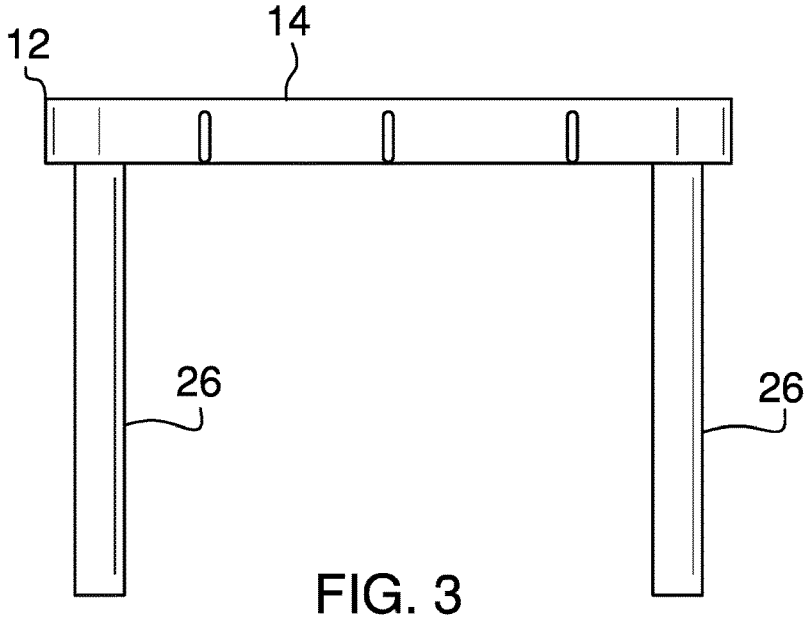
FIG. 3 is a right side view of an embodiment of the disclosure.
Figure 4:
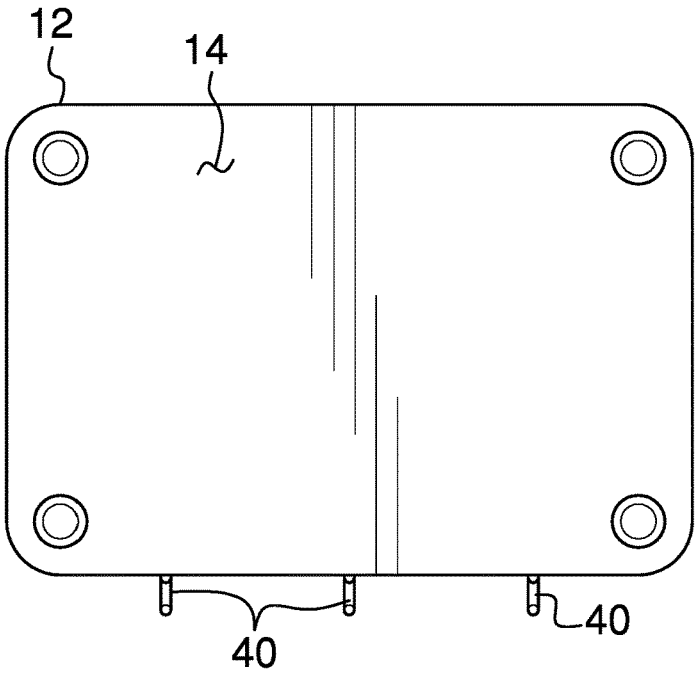
FIG. 4 is a top view of an embodiment of the disclosure.
Figure 5:
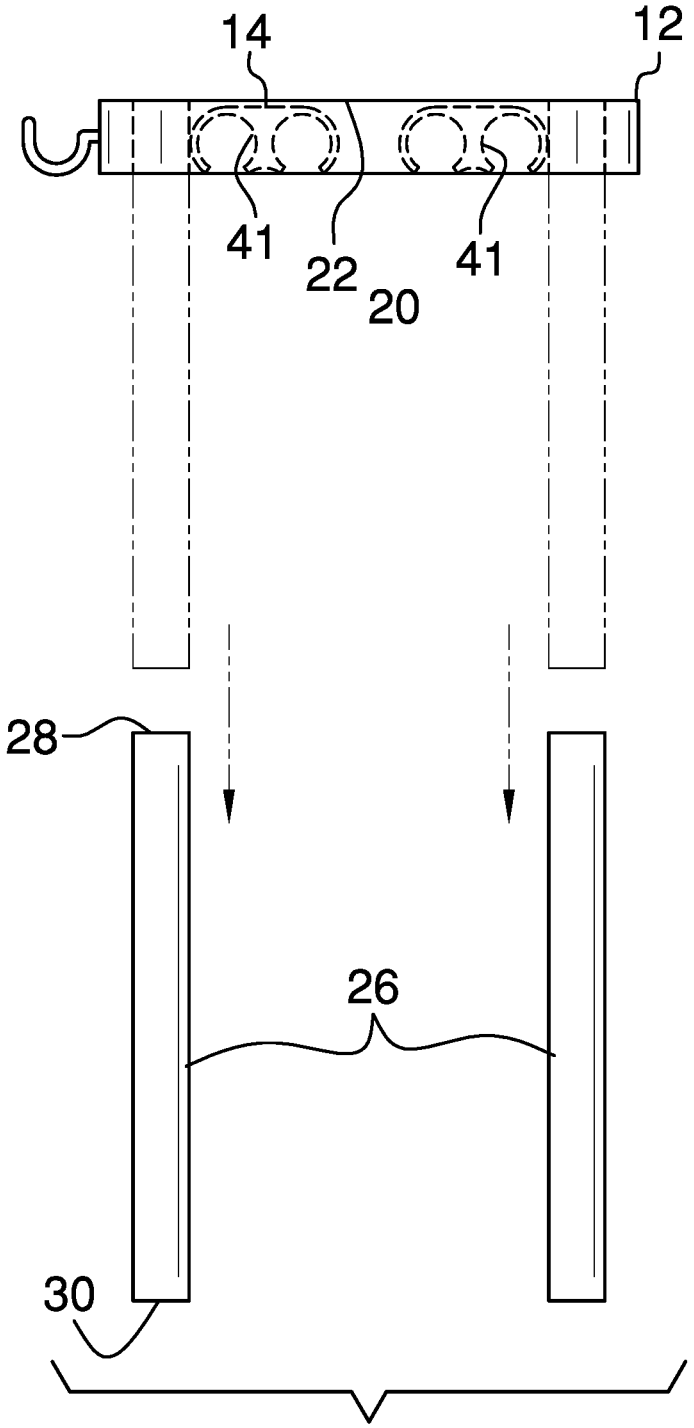
FIG. 5 is a front exploded view of an embodiment of the disclosure.
Figure 6:
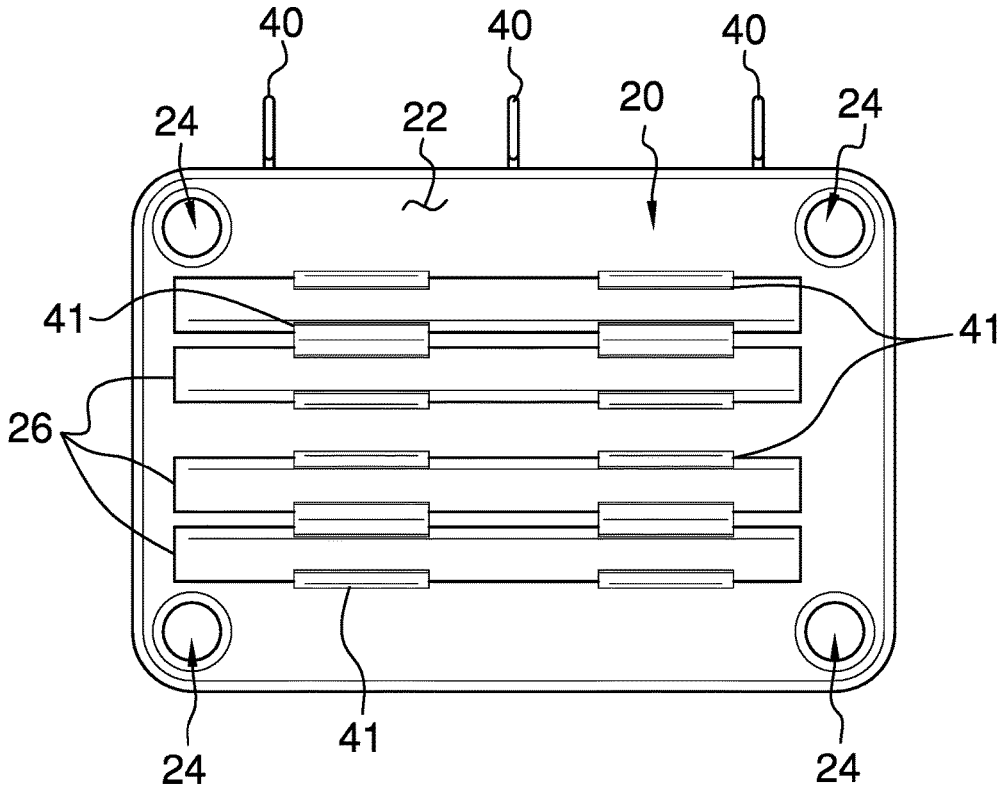
FIG. 6 is a bottom view of an embodiment of the disclosure.

With reference now to the drawings, and in particular to FIGS. 1 through 6 thereof, a new table device embodying the principles and concepts of an embodiment of the disclosure and generally designated by the reference numeral 10 will be described.

As best illustrated in FIGS. 1 through 6, the collapsible table assembly 10 generally comprises a table 12 for supporting objects. The table 12 has a top surface 14, a bottom surface 16 and a peripheral surface 18 extending therebetween. The bottom surface 16 has a well 20 extending toward the top surface 14 and the well 20 has an upper bounding surface 22. The table 12 has a plurality of apertures 24 and each of the apertures 24 extends through the top surface 14 and the bottom surface 16. Each of the apertures 24 is aligned with an associated one of four corners of the table 12.

A plurality of legs 26 is provided and each of the legs 26 is removably coupled to the table 12. Each of the legs 26 may support the table 12 over a support surface, such as sand on a beach, solid ground and any other support surface. Each of the legs 26 has a first end 28 and a second end 30. Each of the apertures 24 insertably receives the first end 28 of an associated one of the legs 26. Each of the legs 26 is fully inserted into the associated aperture 24 such that the first end 28 is aligned with the top surface 14. Moreover, the first end 28 of each of the legs 26 is open and each of the legs 26 is substantially hollow.

A plurality of containers 32 is provided and each of the containers 32 is removably coupled to the table 12 thereby inhibiting the containers 32 from falling over. Each of the containers 32 has a basal wall 34 and an outer wall 36. Additionally, each of the containers 32 has a tab 38 extending downwardly from the basal wall 34. The first end 28 in an associated one of the legs 26 insertably receives the tab 38 on a selected one of the containers 32. In this way the selected container is retained on the top surface 14 of the table 12. The plurality of containers 32 may include a cup, a bowl and any other conventional kitchen container for containing food items or the like.

A plurality of mating members 40 is provided and each of the mating members 40 is coupled to the table 12. Each of the mating members 40 is positioned on the peripheral surface 18 and the mating members 40 are spaced apart from each other. Each of the mating members 40 may be threaded hooks, screws and any other mechanical mating member. A plurality of retainers 41 is each coupled to the upper bounding surface 22 of the well 20. Each of the retainers 41 frictionally engages an associated one of said legs 26 to store the legs 26 in the well 20. Each of the retainers 41 may be clips that have a pair of spaced members for releasbly engaging the legs 26.

A pouch 42 is provided and the pouch 42 is selectively suspended from the mating members 40. The pouch 42 has an outer wall 44 and a top edge 46 defining an opening 48 into the pouch 42 and the pouch 42 may store objects. The outer wall 44 of the pouch has a plurality of grommets 50 extending through the outer wall 36. The grommets 50 are aligned with the top edge 46 and are distributed along the top edge 46. Each of the grommets 50 engages an associated one of the mating members 40 to suspend the pouch 42 from the table 12. A pocket 52 may be coupled to the outer wall 36 of the pouch 42 for additional storage.

In use, the first end 28 of each of the legs 26 is inserted into an associated one of the apertures 24 in the table 12. The legs 26 are positioned on the support surface and the table 12 supports objects. The tab 38 on selected ones of the containers 32 is inserted into the first end 28 of a selected one of the legs 26. Thus, the containers 32 are inhibited from being knocked off of the table 12. The pouch 42 is selectively suspended from the mating members 40 thereby facilitating objects in the pouch 42 to be accessible at the table 12. Each of the legs 26 is selectively removed from the apertures 24 and positioned in the selected retainers 41 for storage.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible table assembly being configured to be transported to a remote location, said assembly comprising:

a table being configured to support objects, said table having a top surface, a bottom surface and a peripheral surface extending therebetween, said bottom surface having a well extending toward said top surface, said well having an upper bounding surface, said table having a plurality of apertures, each of said apertures extending through said top surface and said bottom surface, each of said apertures being aligned with an associated one of four corners of said table;

a plurality of legs, each of said legs being removably coupled to said table wherein each of said legs is configured to support the table over a support surface, each of said legs having a first end and a second end, each of said apertures insertably receiving said first end of an associated one of said legs having said first end being aligned with said top surface, said first end of each of said legs being open, each of said legs being substantially hollow;

a plurality of containers, each of said containers being removably coupled to said table thereby inhibiting said containers from falling over; wherein each of said containers has a basal wall and an outer wall, each of said containers having a tab extending downwardly from said basal wall, said first end in an associated one of said legs insertably receiving said tab on a selected one of said containers to retain said selected container on said top surface of said table;

a plurality of mating members, each of said mating members being coupled to said table; and a pouch being selectively suspended from said mating members, said pouch being configured to store objects.

2. The assembly according to claim 1, further comprising a plurality of retainers, each of said retainers being coupled to said upper bounding surface of said well, each of said retainers frictionally engaging an associated one of said legs to store said legs in said well.

3. A collapsible table assembly being configured to be transported to a remote location, said assembly comprising:

a table being configured to support objects, said table having a top surface, a bottom surface and a peripheral surface extending therebetween, said bottom surface having a well extending toward said top surface, said well having an upper bounding surface, said table having a plurality of apertures, each of said apertures extending through said top surface and said bottom surface, each of said apertures being aligned with an associated one of four corners of said table;

a plurality of legs, each of said legs being removably coupled to said table wherein each of said legs is configured to support the table over a support surface, each of said legs having a first end and a second end, each of said apertures insertably receiving said first end of an associated one of said legs having said first end being aligned with said top surface, said first end of each of said legs being open, each of said legs being substantially hollow;

a plurality of containers, each of said containers being removably coupled to said table thereby inhibiting said containers from falling over, each of said containers having a basal wall and an outer wall, each of said containers having a tab extending downwardly from said basal wall, said first end in an associated one of said legs insertably receiving said tab on a selected one of said containers to retain said selected container on said top surface of said table;

a plurality of mating members, each of said mating members being coupled to said table, each of said mating members being positioned on said peripheral surface, said mating members being spaced apart from each other;

a plurality of retainers, each of said retainers being coupled to said upper bounding surface of said well, each of said retainers frictionally engaging an associated one of said legs to store said legs in said well; and a pouch being selectively suspended from said mating members, said pouch being configured to store objects, said pouch having an outer wall and a top edge defining an opening into said pouch, said outer wall having a plurality of grommets extending through said outer wall, said grommets being aligned with said top edge and being distributed along said top edge, each of said grommets engaging an associated one of said mating members.

* * * * *